US006396202B2

(12) United States Patent
Sugawara et al.

(10) Patent No.: US 6,396,202 B2
(45) **Date of Patent: *May 28, 2002**

(54) ELECTRON GUN STRUCTURE INCLUDING CATHODE SUPPORT STRAP WITH OPENING PORTION

(75) Inventors: Shigeru Sugawara, Saitama-ken; Hirofumi Ueno; Tsutomu Takekawa, both of Fukaya, all of (JP)

(73) Assignee: Kabushiki Kaisha Toshiba, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/295,418

(22) Filed: Apr. 21, 1999

(30) Foreign Application Priority Data

Apr. 23, 1998 (JP) ..... 10-113390

(51) Int. Cl.[7] ..... H01J 1/94; H01J 19/48

(52) U.S. Cl. ..... 313/270; 313/252; 313/263; 313/340

(58) Field of Search ..... 313/270, 263, 313/252, 256, 340; 445/36

(56) References Cited

U.S. PATENT DOCUMENTS 3,857,058 A * 12/1974 Nestleroth ..... 313/417
5,027,029 A * 6/1991 Higuchi et al. ..... 313/446

FOREIGN PATENT DOCUMENTS

JP 57-199939 6/1981
JP 2-2257 1/1990

* cited by examiner

*Primary Examiner*—Vip Patel
*Assistant Examiner*—Kevin Quarterman
(74) *Attorney, Agent, or Firm*—Oblon, Spivak, McClelland, Maier & Neustadt, P.C.

(57) ABSTRACT

A cathode structure comprises a cathode, a cathode sleeve, a cathode holder and a cathode strap. The cathode sleeve contains a heater. A hold structure includes a cylindrical cathode support cylinder for holding the cathode structure, and a cathode support strap having an elongated plate shape and having a cylindrically curved portion engaging the cathode support cylinder. An opening portion is formed in the cylindrically curved portion of the cathode support strap. The cathode support cylinder of the hold structure and the cathode holder of the cathode structure are welded through the opening portion, and the cathode structure is held by the hold structure.

2 Claims, 2 Drawing Sheets

ELECTRON GUN STRUCTURE INCLUDING CATHODE SUPPORT STRAP WITH OPENING PORTION

BACKGROUND OF THE INVENTION

The present invention relates generally to an electron gun structure applied to a color cathode-ray tube apparatus, and more particularly to an in-line type electron gun structure wherein a cathode current can be made close to a predetermined value in a short time from the start of operation.

An in-line type electron gun structure applied to a color cathode-ray tube apparatus comprises three independent cathode structures, a first grid, a second grid and a third grid. The three cathode structures are horizontally arranged in the same plane. The first grid is disposed at a predetermined distance from the three cathode structures and controls three electron beams emitted from the three cathode structures. The second grid is disposed at a predetermined distance from the first grid and shields an electric field varying due to the first grid. The third grid is disposed at a predetermined distance from the second grid and accelerates the three electron beams which have passed through the second grid.

The cathode structure in the in-line type electron gun structure comprises a discoid cathode, a cylindrical cathode sleeve holding the discoid cathode, a cathode holder so formed as to surround the cathode sleeve and to serve as an envelope, and a thin, elongated plate-shaped cathode strap for coupling the cathode sleeve and the cathode holder. A heater for heating the cathode is disposed within the cathode sleeve.

The cathode sleeve is fixed by welding to the cathode strap. The cathode holder is fixed by welding to the cathode strap near a surface of the cathode holder, which is opposed to the first grid. Specifically, the cathode sleeve is fixed to the cathode holder by means of the cathode strap.

The cathode structure is held by a hold structure. The hold structure comprises a cylindrical cathode support cylinder for housing the cathode structure, and a cathode support strap for holding the cathode support cylinder. The cathode support strap is formed of an elongated plate having a cylindrically curved portion with a semicircular cross section. A cylindrical side surface of the cathode support cylinder is covered by, and fixed by welding to, the cylindrically curved portion of the cathode support strap. The length of the cylindrically curved portion in the direction of its generating line is slightly less than that of the side surface of the cathode support cylinder in the direction of its generating line.

The cathode structure is fixed by welding to the hold structure. Specifically, the cathode structure is fixed to the hold structure by welding the cathode holder of the cathode structure to the cathode support cylinder of the hold structure at predetermined weld positions. The weld positions for welding the cathode structure and hold structure are set on that area of the side surface of the cathode support cylinder, which is not covered by the cylindrically curved portion of the cathode support strap. In the hold structure with conventional structure, an area suitable for welding is only one near one end of the side surface of the cathode support cylinder, which is opposite to the first grid in the generating line direction.

In this in-line type electron gun structure, the cathode structures are so designed as to have the same cut-off voltage in order to obtain a good white screen image on the color cathode-ray tube apparatus. Specifically, the electron gun structure is designed such that the cathode current Ik supplied to each cathode structure has a predetermined constant value. However, in normal cases, the cut-off voltages of the respective cathode structures are not necessarily equal. Thus, in order to equalize the cut-off voltages, that is, in order to set the cathode current Ik at a predetermined constant value, a bias voltage is adjusted according to the characteristics of each cathode structure after the color cathode-ray tube apparatus was manufactured.

However, in this type of color cathode-ray tube apparatus, each cathode current Ik cannot be set at a predetermined constant value in a short warm-up time period. The warm-up time period begins when power is supplied to the heater and ends when the structural elements of the electron gun structure heated by the heater have reached the thermal equilibrium state, and it is in general about 20 minutes.

The reason for this is that there is a difference among the structural elements of the electron gun structure with respect to the time period from the switching-on of power to the heater until the structural elements of the electron gun have reached the thermal equilibrium state, and that a distance between a cathode surface of each cathode of the electron gun structure, which cathode surface is opposed to the first grid, and the first grid, that is, a G1/K gap, varies until the cathode current Ik stabilizes at a predetermined constant value.

More specifically, there is a great influence due to a difference in structure between the cathode structure disposed near the heater which directly produces heat, and the hold structure for holding the cathode structure. In other words, in an electron gun structure with grids to which predetermined voltages are applied, the cathode current Ik is determined mainly by the G1/K gap between the cathode surface of the cathode of the cathode structure and the first grid.

The structural elements disposed near the heater are heated and thermally deformed, if power is supplied to the heater. In this case, the heater itself first reaches the thermal equilibrium state and first reaches the stable state. The heater hardly affects the G1/K gap. The cathode strap having a small volume and a thin plate shape is the second to reach the thermal equilibrium state. Since the cathode strap reaches the thermal equilibrium state in a short time, thermal deformation progresses quickly. The cathode sleeve is the third to reach the thermal equilibrium state, and the cathode holder is the fourth.

Following the above, the cathode support cylinder, cathode support strap and first grid reach the thermal equilibrium state in the named order. The cathode support cylinder and cathode support strap have only negligible influence on the G1/k gap in the process of thermal deformation. The influence of the deformation of the first grid is also negligible, since beads or the like are formed around the grid or the plate-like electrode so as to prevent a change in position of the grid.

Thus, during the time period from the switching-on of power to the heater to the reaching to the thermal equilibrium state, the cathode current Ik is affected mainly by the difference in time needed for the cathode strap, cathode sleeve and cathode holder to reach the thermal equilibrium state, and the variation amount of the G1/K gap due to the thermal deformation of each structural element.

In the in-line type electron gun structure with the above-described construction, the time-basis variations of the value of cathode current Ik relative to the time from the switching-on of power to the heater may be separately considered according to the stabilization time periods of the respective structural components: a period A needed for the electron beam to be emitted from the cathode heated by the heater which was powered; a period B needed for the heated cathode strap to reach the thermal equilibrium state; a period C needed for the heated cathode sleeve to reach the thermal equilibrium state; and a period D needed for the heated cathode holder to reach the thermal equilibrium state.

About 20 minutes are needed until the structural elements reach the thermal equilibrium state completely, that is, until the cathode current Ik reaches a predetermined value. About 15 minutes are needed for the period E until the cathode current Ik reaches within a predetermined allowable range of the predetermined value Ik at which the stable state is substantially conformed in visual sense.

The problem with the variation of the cathode current Ik in the warm-up time period is that a considerable amount of time is required for the stabilization of the luminance and chromaticity of the screen when the color cathode-ray tube apparatus is activated. It is desirable that the stable state be quickly reached in visual sense and the period E be decreased.

As has been described above, the electron gun structure has the problem in that a great amount of time is needed from the activation, i.e. switching-on of power to the heater, until the cathode current stabilizes within a predetermined allowable range of values. In the color cathode-ray tube apparatus using the electron gun structure, the warm-up time will increase for achieving predetermined screen luminance and predetermined chromaticity.

BRIEF SUMMARY OF THE INVENTION

The present invention has been made to solve the above problems, and its object is to provide an electron gun structure applicable to a color cathode-ray tube, which is capable of shortening the warm-up time, and obtaining in a short time luminance and chromaticity of predetermined levels without significant difference in visual sense.

According to the present invention, there is provided an electron gun structure comprising:

a cathode structure including a cathode;

a heater for heating the cathode;

a hold structure including a cathode support cylinder in which the cathode structure is inserted and held, and a cathode support strap having an elongated plate shape and having an engagement surface engaging a side surface of the cathode support cylinder;

a grid disposed to be opposed to the cathode; and insulative glass in which a part of the hold structure and a part of the grid are embedded and fixed, wherein the cathode support strap has at least one opening portion formed in a part of the engagement surface, and the cathode structure and the cathode support cylinder are welded through the opening portion and fixed.

According to the electron gun structure of the present invention, the elongated plate-shaped cathode support strap has the opening portion at least in a part of the engagement surface engaging the cathode support cylinder. The cathode support cylinder and the cathode structure are welded through the opening portion and fixed.

Thus, although the time needed for each structural element of the cathode structure and hold structure to reach the thermal equilibrium state is unchanged, the weld position between the cathode structure and the cathode support cylinder can be made closer to the grid and accordingly the thermal deformation amount of each structural element, which may affect the variation of the gap between the cathode and the grid, can be greatly reduced.

More specifically, although the time needed to reach the thermal equilibrium state is unchanged, the state which has no significant difference from the thermal equilibrium state in visual sense can be quickly reached. Therefore, the warm-up time from the activation can be decreased.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of an electron gun structure for a color cathode-ray tube apparatus according to the present invention will now be described with reference to the accompanying drawings.

Figure 1:
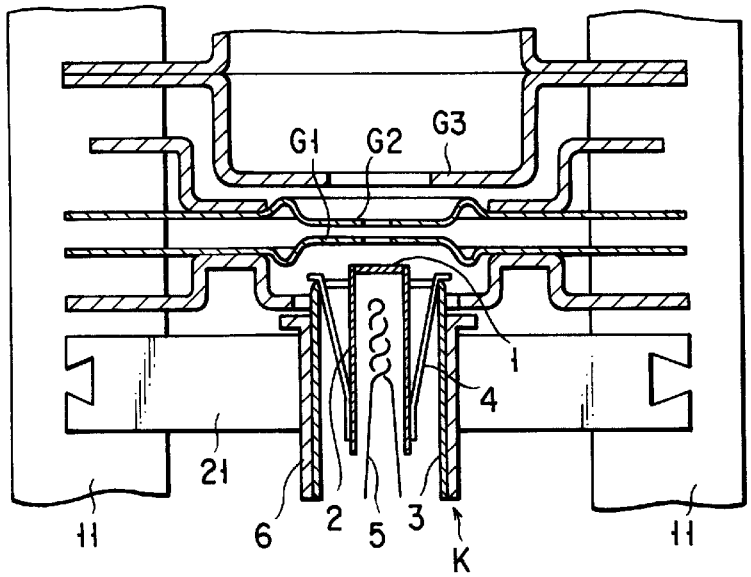
FIG. 1 is a vertical cross-sectional view schematically shows a construction of an in-line type electron gun structure according to the present invention.
Figure 2:
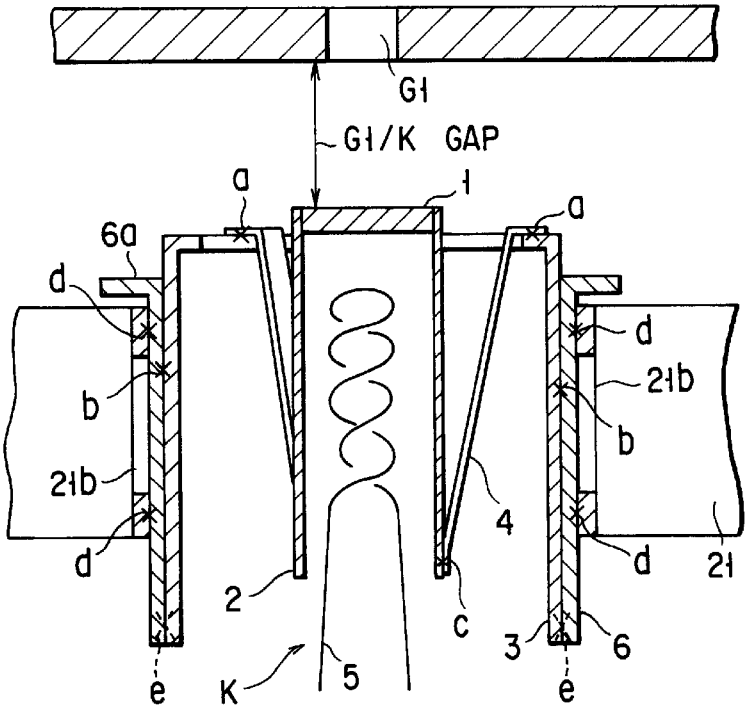
FIG. 2 is a vertical cross-sectional view showing a construction of mainly a cathode structure of the in-line type electron gun structure shown in FIG. 1.

As is shown in FIGS. 1 and 2, an in-line type electron gun structure comprises three independent cathode structures K, a first grid G1 serving as a control grating, a second grid G2 serving as a shield grating, and a third grid G3 serving as an acceleration grating. The three cathode structures K are juxtaposed horizontally in the same plane. FIGS. 1 and 2 are vertical cross-sectional views, taken perpendicular to the horizontal plane in which the three cathode structures K are arranged. FIGS. 1 and 2 show only one cathode structure K.

The first grid G1 is disposed at a predetermined distance from the three cathode structures K and controls three electron beams emitted from the three cathode structures K. The first grid G1 is a plate-shaped electrode and has three electron beam pass holes corresponding to the three cathode structures K.

The second grid G2 is disposed at a predetermined distance from the first grid G1 and shields an electric field varying due to the first grid G1. The second grid G2 is a plate-shaped electrode and has three electron beam pass holes corresponding to the three cathode structures K.

The third grid G3 is disposed at a predetermined distance from the second grid G2 and accelerates the three electron beams which have passed through the second grid G2. The third grid G3 is formed by combining a plurality of cup-shaped electrodes and has three electron beam pass holes corresponding to the three cathode structures K.

In a color cathode-ray tube apparatus to which the above in-line type electron gun structure is applied, three electron beams emitted from the in-line type electron gun structure are converged toward a phosphor screen and focused on red, green and blue phosphor layers of the phosphor screen. In addition, in the color cathode-ray tube apparatus, the electron beams are self-converged and horizontally and vertically scanned on the phosphor screen by a non-uniform magnetic field generated by a deflecting apparatus, which comprises a pincushion-shaped horizontal deflection magnetic field and a barrel-shaped vertical deflection magnetic field. Thus a color image is displayed on the phosphor screen.

As is shown in FIGS. 1 and 2, the cathode structure K of the in-line electron gun structure comprises a cathode 1, a cathode sleeve 2, a cathode holder 3, a cathode strap 4 and a heater 5.

The cathode 1 is formed in a disk shape. The cathode sleeve 2 has a cylindrical shape and holds the discoid cathode 1 at a circular opening formed at one end in its axial direction. The cathode holder 3 has a cylindrical shape and also has a circular opening portion at one end in its axial direction with an inside diameter greater than the diameter of the cathode sleeve 2. The cathode holder 3 serves as an envelope surrounding the cathode sleeve 2. The cathode strap 4 has a thin elongated plate shape for coupling the cathode sleeve 2 and cathode holder 3. The heater 5 is disposed within the cathode sleeve 2 and heats the cathode 1.

The cathode sleeve 2 is welded and fixed to the cathode strap 4 at a weld position c located on the other end side in its axial direction, that is, opposite to the first grid G1. The cathode holder 3 is welded and fixed to the cathode strap 4 at a weld position a near the circular opening portion provided at one end thereof in its axial direction. Specifically, the cathode sleeve 2 is fixed to the cathode holder 3 by means of the cathode strap 4 such that the surface of the cathode 1 opposed to the first grid G1, that is, the cathode surface, is situated closer to the first grid G1 than the circular opening provided at one end of the cathode holder 3.

Figure 3:
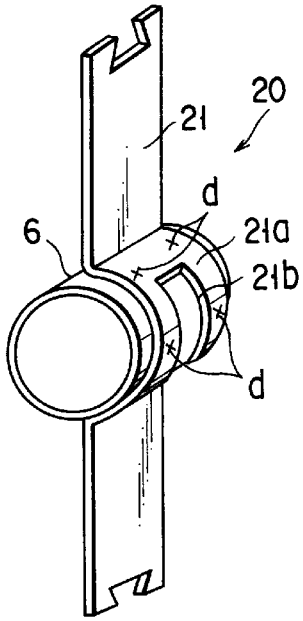
FIG. 3 is a perspective view schematically showing a hold structure for holding the cathode structure shown in FIG. 2.

The cathode structure K is held by a hold structure 20, as shown in FIG. 3. The hold structure 20 comprises a cylindrical cathode support cylinder 6 in which the cathode structure K can be inserted, and a cathode support strap 21 for holding the cathode support cylinder 6.

The cathode support cylinder 6 has a flange 6*a* around a circular opening portion provided at one end thereof in its axial direction. The inside diameter of the cathode support cylinder 6 is substantially equal to the outside diameter of the cathode holder 3.

The cathode support strap 21 has an elongated plate shape with a cylindrically curved portion 21*a* serving as an engaging surface for engagement with a cylindrical side surface of the cathode support cylinder 6. The cross section of the cylindrically curved portion 21*a* is substantially semicylindrical, and its radius of curvature is substantially equal to that of the outer surface of the cathode support cylinder 6. The curved portion 21*a* has an opening portion 21*b* formed along its curved surface at a substantially central area thereof.

The cylindrical side surface of the cathode support cylinder 6, as shown in FIGS. 2 and 3, is covered by the cylindrically curved portion 21*a* of cathode support strap 21, and both are fixed by welding at a weld position d.

The cathode structure K is fixed by welding to the hold structure 20. Specifically, the cathode structure K is fixed to the hold structure 20 by welding the cathode holder 3 of cathode structure K to the cathode support cylinder 6 of hold structure 20 at predetermined weld positions. The weld positions for welding the cathode structure K and hold structure 20 are set on that area of the side surface of the cathode support cylinder 6, which is not covered by the cylindrically curved portion 21*a* of cathode support strap 21. As will be described later, it is desirable that the weld positions be set near the first grid, in order to suppress a thermal deformation amount of each structural element which affects the variation of the gap between the cathode surface of the cathode structure K and the first grid G1, that is, a G1/K gap.

As is shown in FIGS. 2 and 3, the cathode holder 3 is fixed to the cathode support cylinder 6 by welding at weld positions b closer to the first grid G1 through the opening portion 21*b* of cathode support strap 21. Specifically, the cathode support cylinder 6 is welded and fixed to the cathode holder 3 of cathode structure K at substantially middle positions in the generating line direction on the cylindrical surface of the support cylinder 6, and more preferably at positions closer to the first grid G1.

With the above structure, the weld positions b for welding the cathode support strap 21 of hold structure 20 to the cathode holder 3 of cathode structure K can be made closer to the first grid G1 and to the weld positions a for welding the cathode holder 3 to the cathode strap 4.

The first, second and third grids, as shown in FIG. 1, are embedded and fixed in a pair of insulative glass members 11 at predetermined intervals. The cathode structure K, being held by the hold structure 20, is fixed such that parts of the cathode support strap 21 of hold structure 20 are embedded in the insulative glass members 11.

By constructing the cathode structure K and hold structure 20 of the in-line type electron gun structure, the thermal deformation amount of each structural element can be greatly reduced, though the time needed for each structural element to reach the thermal equilibrium state is unchanged.

More specifically, though the time needed for each structural element to reach the thermal equilibrium state is unchanged, each structural element can reach a state in which there is no significant difference in visual sense from the thermal equilibrium state.

In the above-described in-line type electron gun structure, if power is supplied to the heater 5, the heater 5 produces heat and heats the cathode 1, whereby the cathode surface of the cathode 1 emits thermoelectrons. The thermoelectrons emitted from the cathode 1 form an electron beam, and the electron beam is controlled and accelerated by the first, second and third grids G1, G2 and G3.

At the same time, the cathode structure K begins to thermally deform due to the heat from the heater 5. Specifically, the cathode strap 4 extends so as to increase the G1/K gap. The cathode sleeve 2 extends so as to decrease the G1/K gap. The cathode holder 3 extends due to thermal deformation, similar with prior art. In this case, the time needed for each structural element to reach the thermal equilibrium state is unchanged, compared to the prior art, but the amount of variation of the G1/K gap due to thermal deformation can be reduced, compared to the prior art, since the distance between the weld position a between the cathode holder 3 and cathode strap 4 and the weld position b between the cathode holder 3 and cathode support cylinder 6 is shorter.

Since the amount of variation of the G1/K gap is reduced, the amount of variation of cathode current Ik can be reduced and the cathode current Ik can be stabilized more quickly. Accordingly, the warm-up time can be reduced.

Figure 4:
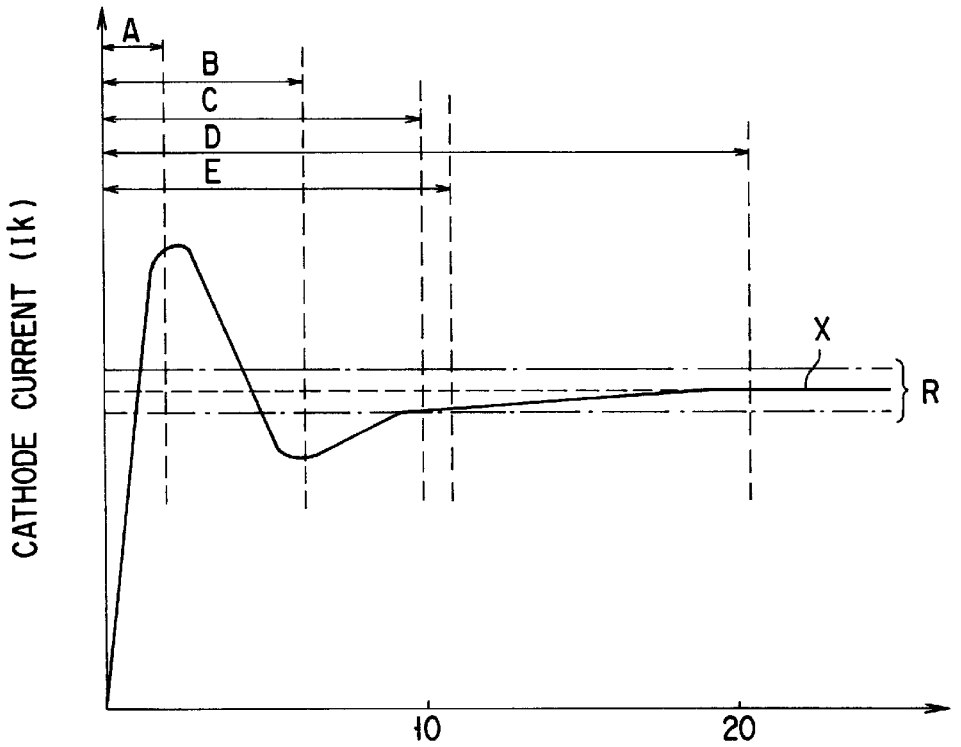
FIG. 4 is a graph showing a time-basis variation in cathode current after a heater is powered, in a case where a cathode holder is welded to a cathode support cylinder at a weld position b through an opening portion of a cathode support strap in the electron gun structure shown in FIG. 2.
Figure 5:
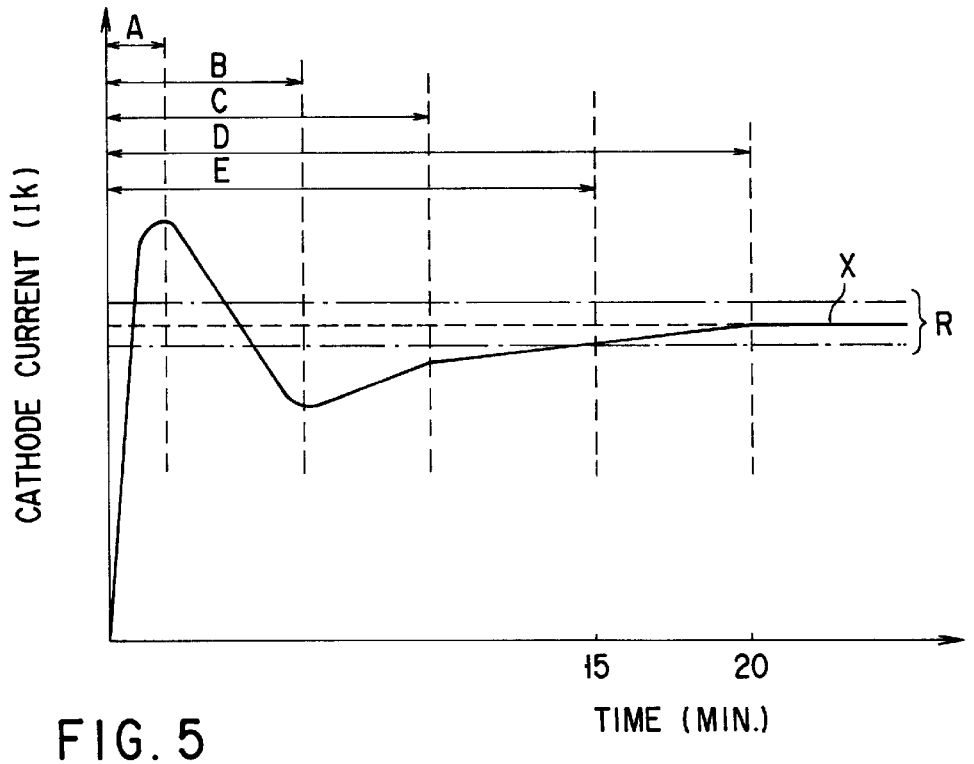
FIG. 5 is a graph showing a time-basis variation in cathode current after the heater is powered, in a case where the cathode holder is welded to the cathode support cylinder, not through the opening of the cathode support strap, at a weld position e (indicated by broken line) near one end of a side surface of the cathode support cylinder, which end is opposite to a first grid in the generating line direction in an electron gun structure according to a comparative example.

FIGS. 4 and 5 are graphs showing time-basis variations of cathode current Ik after power is supplied to the heater in the in-line type electron gun structure. FIG. 4 corresponds to the case where the cathode holder 3 and cathode support cylinder 6 are welded, as shown in FIG. 2, at the weld positions b through the opening portion 21*b* of cathode support strap 21. FIG. 5 corresponds to the case where the cathode holder 3 is welded to the cathode support cylinder 6, not through the opening portion 21*b* of the strap 21, at weld positions e (indicated by broken lines) near one end of the side surface of the cathode support cylinder 6, which end is opposite to the first grid in the generating line direction of the side surface of cylinder 6.

As is shown in FIGS. 4 and 5, the time-basis variations of the value of cathode current Ik after the heater is powered may be separately considered according to the stabilization time periods of the respective structural components: a period A needed for the electron beam to be emitted from the cathode heated by the heater which was powered; a period B needed for the heated cathode strap to reach the thermal equilibrium state; a period C needed for the heated cathode sleeve to reach the thermal equilibrium state; and a period D needed for the heated cathode holder to reach the thermal equilibrium state.

As is shown in FIGS. 4 and 5, the time periods A, B, C and D needed for the cathode, cathode strap, cathode sleeve and cathode holder to reach the thermal equilibrium state do not differ, depending on the weld positions. That is, the period D needed for the cathode current Ik to reach a predetermined value X is about 20 minutes in both cases of FIGS. 4 and 5.

By contrast, a time period E needed for the cathode current Ik to stabilize within an allowable range R of the predetermined value X, that is, needed for the cathode current Ik to reach a stable state confirmed in visual sense, varies greatly depending on the weld positions, as shown in FIGS. 4 and 5. Specifically, where the weld position for welding the cathode holder 3 and cathode support cylinder 6 is closer to the first grid G1 and to the weld position a between the cathode holder 3 and cathode strap 4, that is, in the case of the weld position b, the thermal deformation amount of respective elements which may affect the variation in the G1/K gap can be made smaller.

In particular, compared to the case where the cathode holder 3 thermally expands toward the first grid G1 from the weld position e, which is the point of start of expansion, the thermal deformation possibly affecting the variation in the G1/K gap can be reduced where the cathode holder 3 thermally expands toward the first grid G1 from the weld position b which is the point of start of expansion. In addition, since the weld position b between the cathode holder 3 and cathode support cylinder 6 is close to the weld position a between the cathode holder 3 and the cathode strap 4 which extends away from the first grid G1, that is, in such a direction as to increase the G1/K gap, the relative thermal deformation amount of these structural parts can be reduced.

Accordingly, compared to the case shown in FIG. 5, the variation amount of the cathode current Ik can be reduced in the case shown in FIG. 4, and the cathode current Ik can be stabilized within the allowable range R in a shorter time period. The period E needed for the cathode current Ik to substantially reach the stable state confirmed in visual sense is 15 minutes in the case of the weld position e, as shown in FIG. 5, while it decreases greatly to about 10 minutes in the case of the weld position b, as shown in FIG. 4.

As has been described above, in order to shorten the warm-up time period, i.e. the period E, it is effective to reduce the thermal deformation amount of the cathode holder 3 which requires a longest time to reach the thermal equilibrium state after power is supplied to the heater 5. To achieve this, the opening portion 21*b* is formed in the cylindrically curved portion 21*a* of the cathode support strap 21 and, through this opening portion 21*b*, the cathode support cylinder 6 of support structure 20 is welded and fixed to the cathode holder 3 of the cathode structure K.

Thereby, the weld position a between the cathode holder 3 and cathode strap 4 can be made closer to the weld position b between the cathode holder 3 and cathode support cylinder 6, without losing a balance in mechanical strength of the cathode structure K.

Therefore, the luminance and chromaticity can be quickly approached to predetermined values when the color cathode-ray tube apparatus is activated, and the warm-up time period is substantially improved.

As has been described above, the present invention can provide an electron gun structure applicable to a color cathode-ray tube apparatus, which is capable of shortening the warm-up time, and obtaining in a short time luminance and chromaticity of predetermined levels without significant difference in visual sense.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An electron gun structure including three electron guns that are arranged in a same plane, said electron gun comprising:

a cathode structure including a cathode;

a heater for heating the cathode;

a hold structure including a cathode support cylinder in which the cathode structure is inserted and held, and a cathode support strap having an elongated plate shape and having an engagement surface engaging a side surface of the cathode support cylinder;

a grid disposed to be opposed to the cathode; and insulative glass in which a part of the hold structure and a part of the grid are embedded and fixed, wherein the cathode support strap has at least one opening portion formed in a part of the engagement surface, and the cathode structure and the cathode support cylinder are welded at a weld point through the opening portion and fixed.

2. An electron gun structure including three electron guns that are arranged in a same plane, said electron gun comprising:

a cathode structure including a discoid cathode, a cylindrical cathode sleeve holding the cathode, a cylindrical cathode holder housing the cathode sleeve, and a cathode strap for coupling the cathode sleeve to the cathode holder;

a heater, disposed within the cathode sleeve of the cathode structure, for heating the cathode;

a hold structure including a cathode support cylinder with a cylindrical side surface, in which the cathode structure is inserted and held, and a cathode support strap having an elongated plate shape and having a cylindrically curved surface engaging a side surface of the cathode support cylinder;

a grid disposed to be opposed to the cathode; and insulative glass in which a part of the hold structure and a part of the grid are embedded and fixed, wherein the cathode strap for fixing the cathode sleeve is welded at a position near a portion of the cathode holder, which is opposed to the grid, the cathode support strap has at least one opening portion formed in a part of the cylindrically curved portion, the cathode holder of the cathode structure and the cathode support cylinder of the hold structure are welded at a weld point through the opening portion and fixed.

* * * * *